US005518111A

United States Patent [19]

Stout

[11] Patent Number: 5,518,111

[45] Date of Patent: May 21, 1996

[54] REMOVABLE DIVIDER PANEL FOR MULTIPLE-TIER ARTICLE PACKAGE

[75] Inventor: James T. Stout, Ellijay, Ga.

[73] Assignee: The Mead Corporation, Dayton, Ohio

[21] Appl. No.: 204,971

[22] Filed: Mar. 2, 1994

[51] Int. Cl.[6] ..... B65D 75/00

[52] U.S. Cl. ..... 206/160; 206/193; 206/427

[58] Field of Search ..... 206/151, 152, 206/158, 160, 161, 193, 196, 197, 427, 430, 593, 821, 194

[56] References Cited

U.S. PATENT DOCUMENTS

| | | | |
|---|---|---|---|
| 2,919,844 | 1/1960 | Anderson, Jr. | 206/194 X |
| 3,121,523 | 2/1964 | Hasselo | 206/155 X |
| 3,351,264 | 11/1967 | Bostrom | 229/120.32 |
| 4,756,419 | 7/1988 | LeBras | 206/430 |
| 4,789,063 | 12/1988 | Hammett | 206/432 |
| 5,072,876 | 12/1991 | Wilson | 206/427 X |
| 5,246,113 | 9/1993 | Schuster | 206/430 |

*Primary Examiner*—Jacob K. Ackun
*Attorney, Agent, or Firm*—Michael V. Drew

[57] ABSTRACT

A divider panel (20) has a major panel (22) with attached anchor flaps (24, 26) for securing the panel (20) in a multiple-tier article package. The anchor flaps (24, 26) are attached to the major panel (22) along perforated lines (23) that permit the anchor flaps (24, 26) and major panel (22) to be separated from one another. The divider panel (20) is scored with lines (28, 30, 32, 34, 36) that encourage bending of the divider panel (20) about axes defined by the scored lines (28, 30, 32, 34, 36). One or more apertures (37) in the major panel (22) enable a finger or fingers to be inserted to facilitate removal of the major panel (22) or the entire divider panel (20) from the carton. A carton which contains the divider panel (20) has a tear-away flap (171) which is integrally formed with an end closure of the carton and which is attached to an anchor flap of the divider panel (152). The divider panel (152) may be removed from the carton by tearing away the tear-away flap (171) from its end closure and withdrawing the divider panel (152) from the carton through the opening created by removal of the tear-away flap (171).

28 Claims, 8 Drawing Sheets

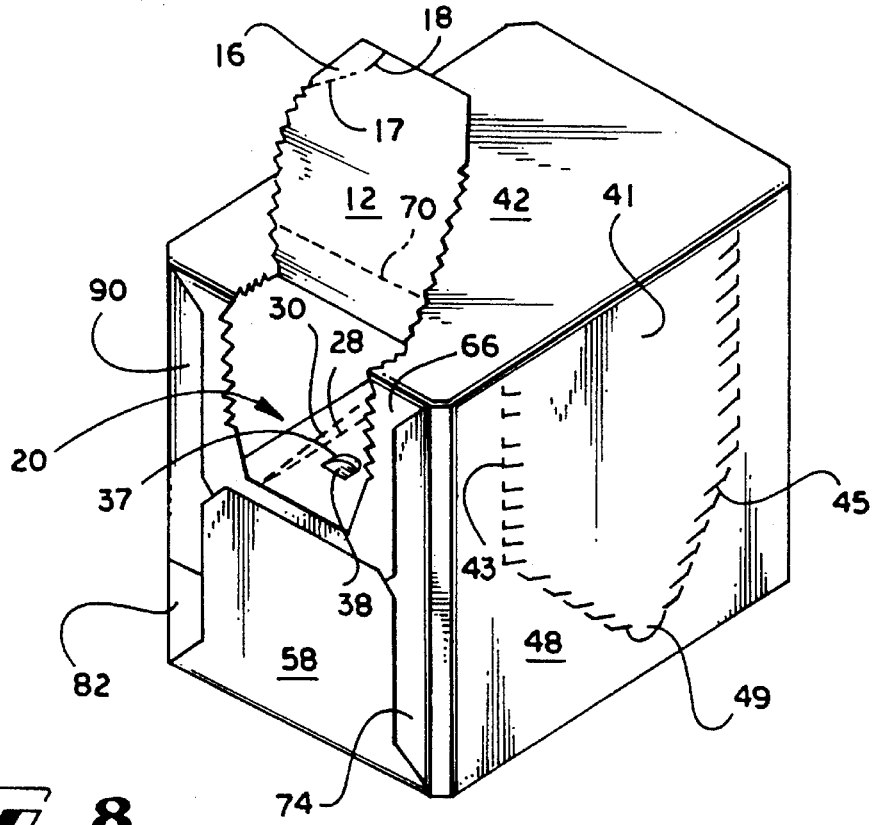
Fig. 8
Fig. 9
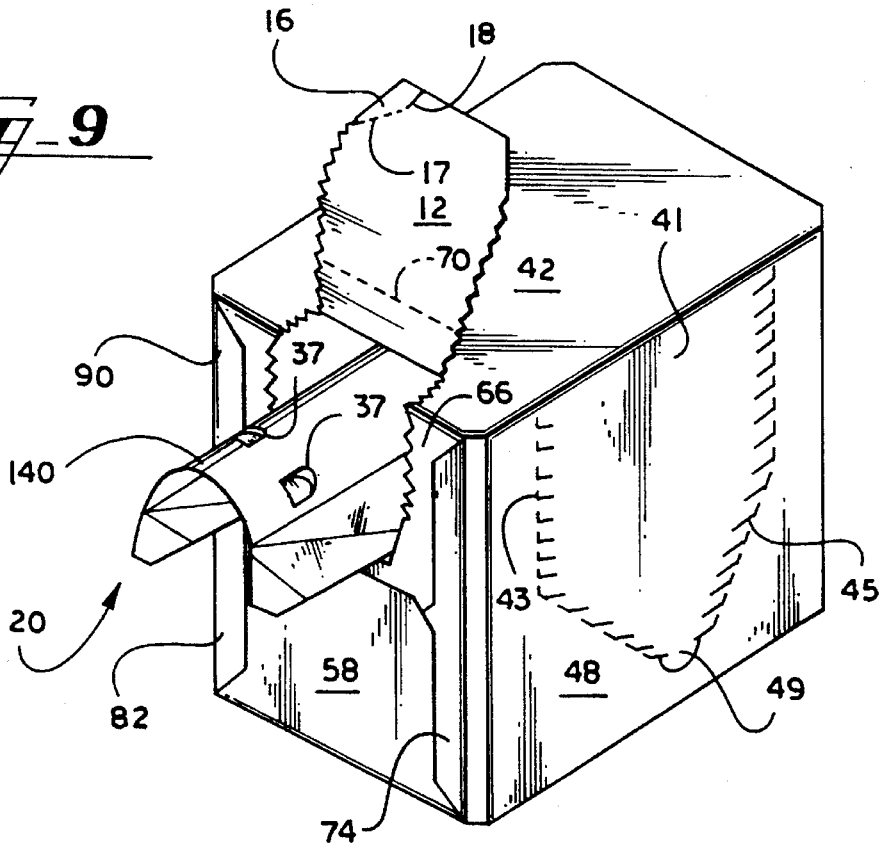

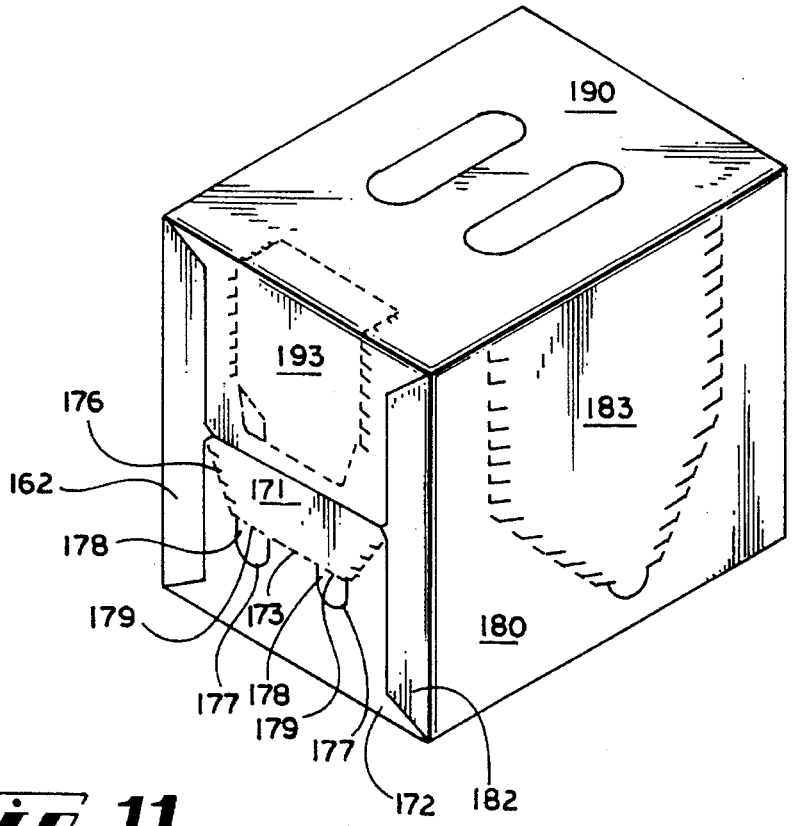
Fig_11
Fig_12
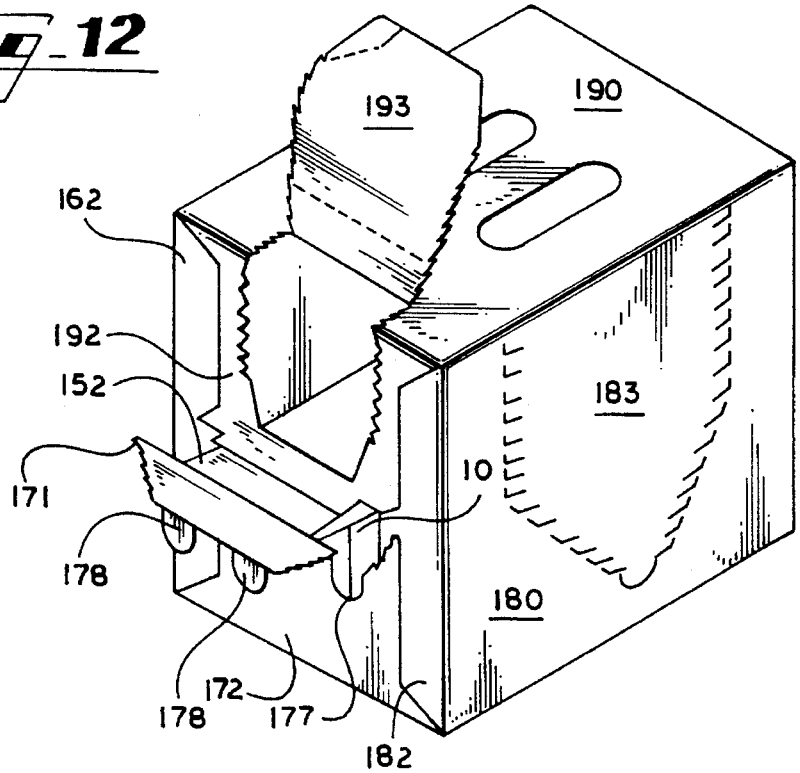

REMOVABLE DIVIDER PANEL FOR MULTIPLE-TIER ARTICLE PACKAGE

BACKGROUND OF THE INVENTION

The invention relates generally to packages of articles such as beverage cans or similar containers arranged in two or more tiers separated by a divider panel, and more particularly to means for removing the divider panel from the package to gain access to the lower tier of beverages after the upper tier has been removed.

In merchandising articles such as cans of beverage it is often desirable to package multiple articles in a single container for distribution and sale. To encase a substantial number of articles Such as beverage cans it is convenient to arrange the cans in-two or more tiers in a single package. A divider panel is useful in a package encasing two or more tiers to separate the bottoms of one tier of articles from the tops of a lower tier of articles. Separation of tiers of articles provides a stronger, more reliable overall package. In many instances it is simply undesirable for articles, such as cans, on one tier to be in contact with articles on another tier. In using a divider panel, the ends of the divider panel may be anchored by an adhesive or other means to the inner surface of the carton to prevent unwanted movement of the panel and to increase the overall stability of the package.

When the package is used as a dispenser, beverage cans, or other encased articles, may be removed from the package through an opening in the carton created by lifting a flap. Once the package is opened, cans are normally removed first from the topmost tier through the opening in the carton wall. After cans have been removed from the topmost tier the anchored divider panel must be removed to gain access to the cans on a lower tier of the package. Thus, although the divider panel is useful for segregating successive tiers of cans, it also prevents access to lower tiers of cans when the package is used as a dispenser.

What is needed, therefore, is a divider panel for a multiple-tier package that may be easily removed to gain access to a tier of cans beneath the divider panel.

SUMMARY OF THE INVENTION

The present invention provides a divider panel having a major panel with attached anchor flaps for securing the panel in a multiple-tier article package. The anchor flaps are attached to the major panel along perforated lines that permit the anchor flaps and major panel to be separated from one another. The divider panel is scored with lines that encourage bending of the divider panel about axes defined by the scored lines. One or more apertures in the major panel enable a finger or fingers to be inserted to facilitate removal of the major panel or the entire divider panel from the carton. There is also provided a carton for use with the divider panel, having a tear-away flap integrally formed with an end closure of the carton and attached to an anchor flap of the divider panel. The divider panel may be removed from the carton by tearing away the tear-away flap from its end closure and withdrawing the divider panel from the carton through the opening created by removal of the tear-away flap.

Other advantages and objects of the present invention will be apparent from the following description, the accompanying drawings, and the appended claims.

BRIEF DESCRIPTION OF THE DRAWINGS

FIG. 8 is a perspective view of the package of FIG. 7, showing the divider panel of FIG. 1 as seen through an end opening of the carton providing access to the upper tier of the two-tier package.

FIG. 9 is the same view as FIG. 8, showing the divider panel partially curled and partially removed from the carton.

FIG. 11 is a perspective view of a package formed from the blank of FIG. 10.

FIG. 12 is an illustration of the package of FIG. 11 with the end flap opened, the top layer of cans removed and a removable divider panel partially extracted by means of a flap integrally formed with the carton.

DETAILED DESCRIPTION OF THE PREFERRED EMBODIMENT

Figure 1:
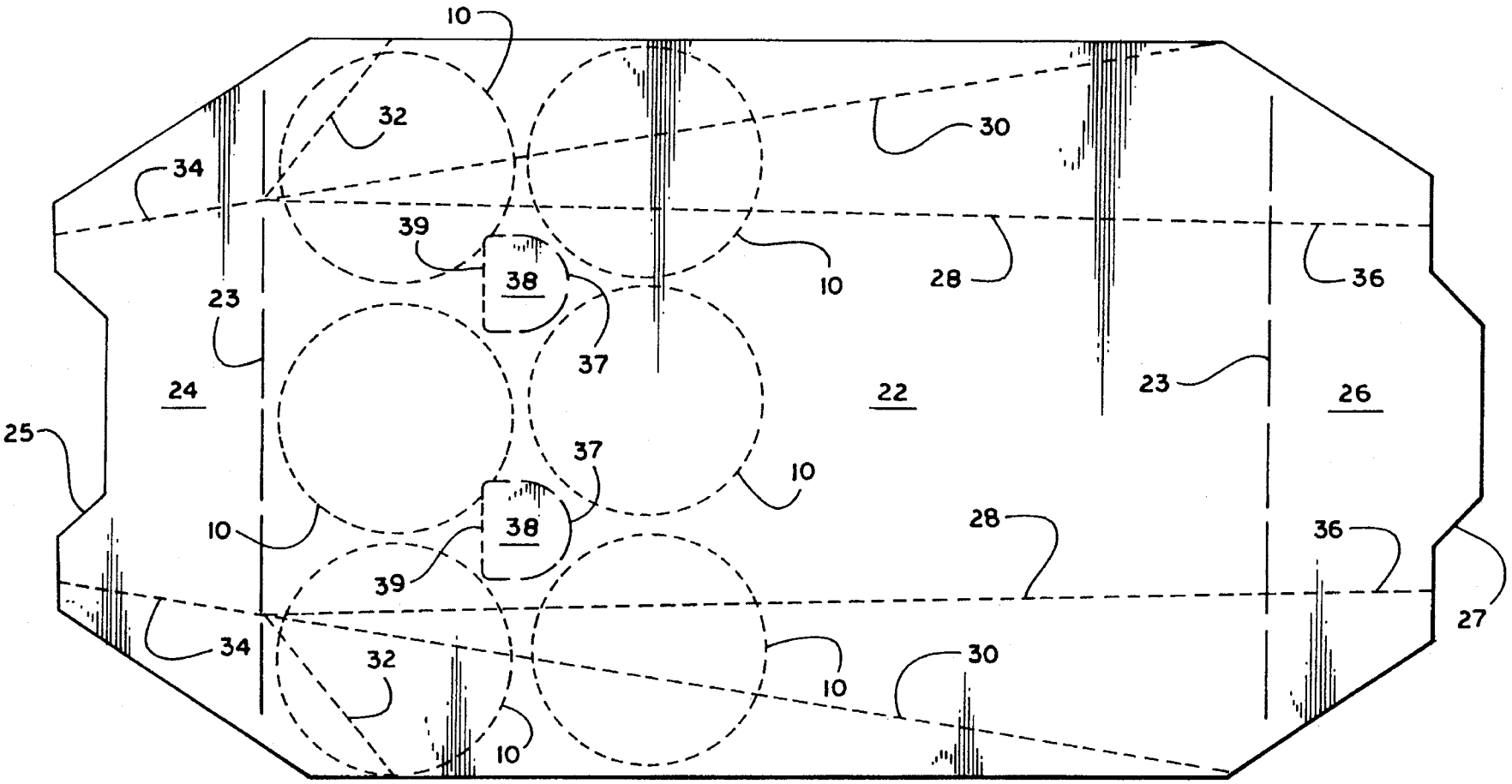
FIG. 1 is a plan view of a removable divider panel in accordance with the preferred embodiment of the present invention.

The present invention is intended primarily for use in separating adjacent tiers of articles in a paperboard carton forming a multiple-tier package. The invention is particularly suitable for use with multiple tiers of aluminum or steel beverage cans and, although more broadly applicable, for convenience will be explained in this context. A typical can is denoted throughout the drawings by the numeral 10. The typical can 10 generally has a single-piece, seamless drawn body with a top lid and a lower covered end. The top lid is generally recessed within a peripheral flange. The divider panel is constructed so that it may be easily withdrawn through an opening in the carton through which individual cans may be removed. The removable divider panel of the preferred embodiment of the invention is designed to enable a main panel to be torn away from anchor flaps which secure the panel in the carton. The divider panel is also designed to bend in a manner that makes removal easier. In the drawings and description which follow, although the divider panel is described for use in conjunction with typical cartons, it will be clearly understood that the panel of the invention may be used with cartons having configurations differing from those described herein.

Referring first to FIG. 1, therein is illustrated a removable divider panel 20 for a multiple-tier can package according to a preferred embodiment of the invention. To better understand the features of the divider panel 20 that will now be described, FIGS. 1 and 2 may be referred to simultaneously. The divider panel 20 illustrated is suitable for use with an elongated array of cans 10 such as the 3×4 array shown in FIG. 2. The divider panel 20 has a major panel 22 with an anchor flap 24, 26 attached at either end of the main panel 22 along respective perforated fold lines 23.

Although the ends of the divider panel 20 and the anchor flaps 24, 26 may be shaped to create a rectangular or otherwise overall rectilinear divider panel, the corners of the major panel 22 of the divider panel 20 are bevelled and coincide with the inclined edges of the anchor flaps 24, 26. The bevelled corners of the divider panel 20 are configured to correspond to a carton having bevelled corners but are also suitable for a carton having square corners. The relationship between the carton and the divider panel 20 is discussed in greater detail below.

The anchor flaps 24, 26 may be rectilinear but are shown in a configuration that permits maximum extension of each flap 24, 26 from its line of connection 23 at the major panel 22 while requiring as little construction material as possible. The inclined side edges of the anchor flaps 24, 26 cut off the corners of the anchor flaps 24, 26, thereby reducing the amount of material such as paperboard needed to produce the divider panel 20. The amount of material necessary to produce the anchor flaps 24, 26 (and divider panel 20) is further optimized by the corresponding nesting configuration of the opposing anchor flaps 24, 26. The leading edge 25 of one anchor flap 24 has an indentation while the leading edge 27 of the opposite anchor flap 26 has a protrusion corresponding to the indented edge 25. Without the indentation in the indented edge 25, a greater amount of material would be required to produce an anchor flap that extends beyond the fold line 23 the same effective distance. The protrusion of the protruding edge 27 of the anchor flap 26 likewise creates maximum extension beyond the fold line 23 while utilizing minimum material. The corresponding indented 25 and protruding 27 edges also permit the panels 20 to be cut from a sheet of material in a nested fashion whereby the indented edge 25 of the anchor flap 24 of one divider panel 20 nests with the protruding edge 27 of the anchor flap 26 of another divider panel 20 being cut from the same sheet of material. This nested manufacturing process minimizes waste of unused material.

The divider panel 20 is scored with lines that facilitate bending of the divider panel 20 about the scored lines. Although these scored lines may be arranged in many different patterns, the preferred embodiment illustrates an arrangement of a set of scored lines 28, 30, 32, 34, 36 that generally radiate from points on one of the fold lines 23. As will be discussed in greater detail below, when the divider panel 20 is positioned within a carton for use, the anchor flaps 24, 26 are folded downward and the fold lines 23 between the major panel 22 and the anchor flaps 24, 26 abut the inner walls of the carton. The fold line 23 from which the scored lines 28, 30, 32, 34, 36 radiate becomes the end of the major panel 22 that will be removed first from the carton. Although a single scored line may be used, use of multiple scored lines creates more individual sections that are subject to easy bending. In the preferred embodiment, an innermost set of scored lines 28 is essentially parallel to the sides of the major panel 22 while the two additional sets of scored lines 30, 32 radiate in a divergent pattern along the length of the divider panel 20. What may be considered a set of converging scored lines 34 (with respect to the manner in which they radiate from the fold line 23) extend through one of the anchor flaps 24 and coincide with one of the diverging sets of scored lines 30. As will be described in greater detail below, the scored lines 34 in the anchor flap 24 are useful for promoting bending of the anchor flap 24 if the major panel 22 is to be removed from the carton without first detaching that anchor flap 24. A set of parallel scored lines extend through the second anchor flap 36 and coincide with the parallel lines 28 of the major panel. The scored lines 36 in the anchor flap 26 are useful for promoting bending of the end flap 26 if the major panel 22 is to be removed from the carton without first detaching that anchor flap 26.

A pair of apertures are formed in the major panel 22 by perforated cut lines 37. The apertures 37 become accessible by removing punch-out tabs 38 which remain connected to the major panel 22 of the divider panel 20 by scored fold lines 39. The apertures 37 are positioned upon the divider panel 20 such that they are aligned over the spacing formed between adjoining cans 10 of an array when the divider panel 20 is placed over that array of cans 10. To illustrate this alignment, FIG. 1 depicts in phantom form representative cans 10 of a tier upon which the panel 20 rests.

Figure 2:
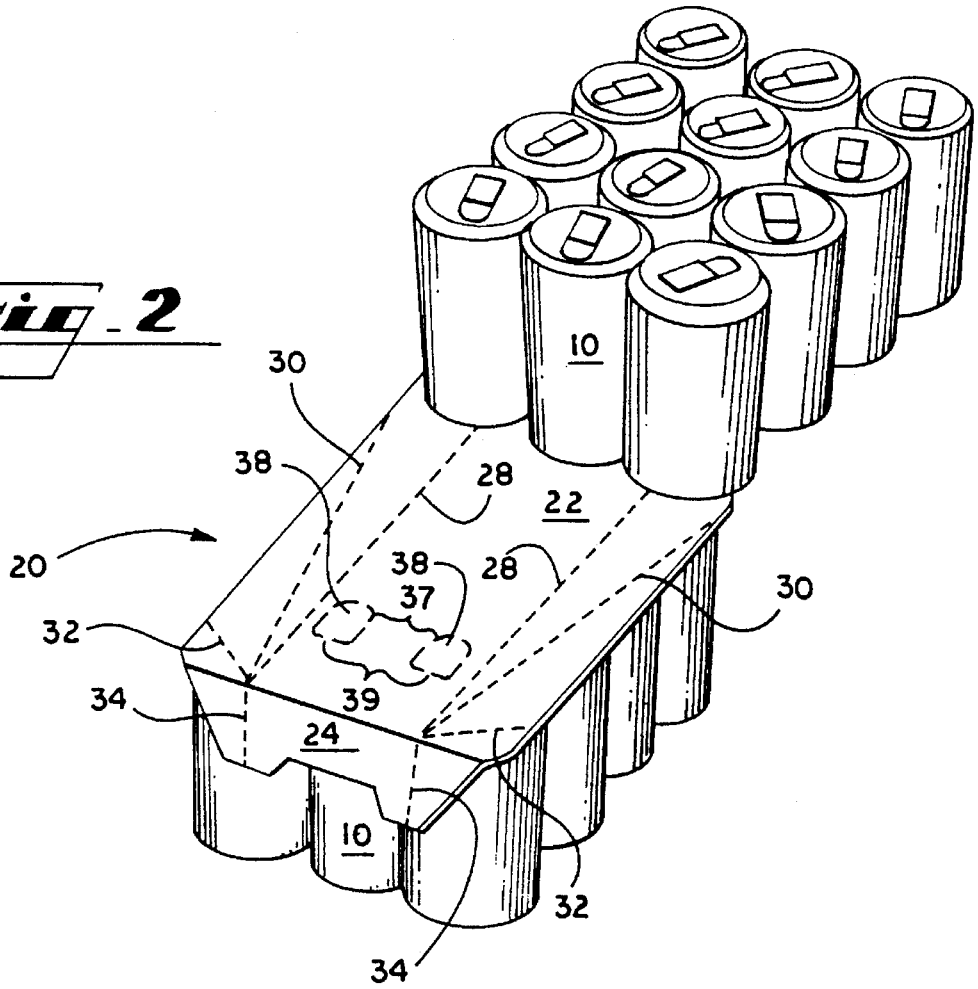
FIG. 2 is a perspective view of two tiers of cans separated by the removable divider panel of FIG. 1, wherein the two tiers of cans are partially arranged for placement within a carton.
Figure 3:
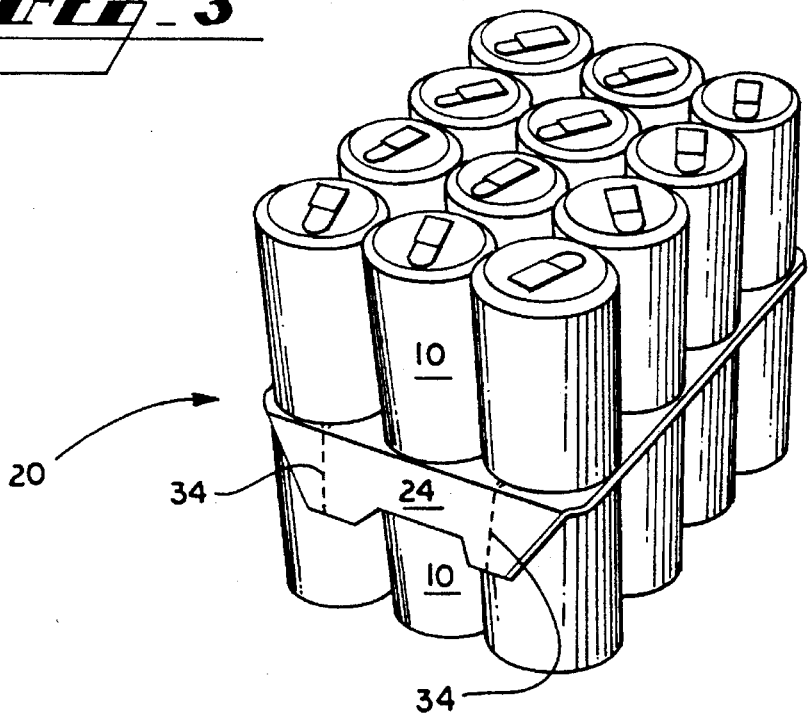
FIG. 3 is a perspective view of the two tiers of cans and divider panel shown in FIG. 2, wherein the two tiers of cans are arranged over one another for placement within a carton.

Referring now particularly to FIG. 2, therein is shown a manner in which the divider panel 20 may be positioned for use between two tiers of cans 10 in 3×4 arrays. In general, the panel 20 is positioned over the bottom tier of cans 10 so that the apertures 37 and punch-outs 38 are aligned over spaces between the tops and sides of the cans 10 of the first and second rows of the bottom tier. The upper tier of cans 10 may then be positioned over the lower tier, as shown in FIG. 3. FIGS. 2 and 3 also illustrate the manner in which the anchor flaps 24, 26 (only one anchor flap 24 is visible in the views of FIGS. 2 and 3) are folded downward so that the two-tiered stacked array is ready for loading into a carton.

Figure 4:
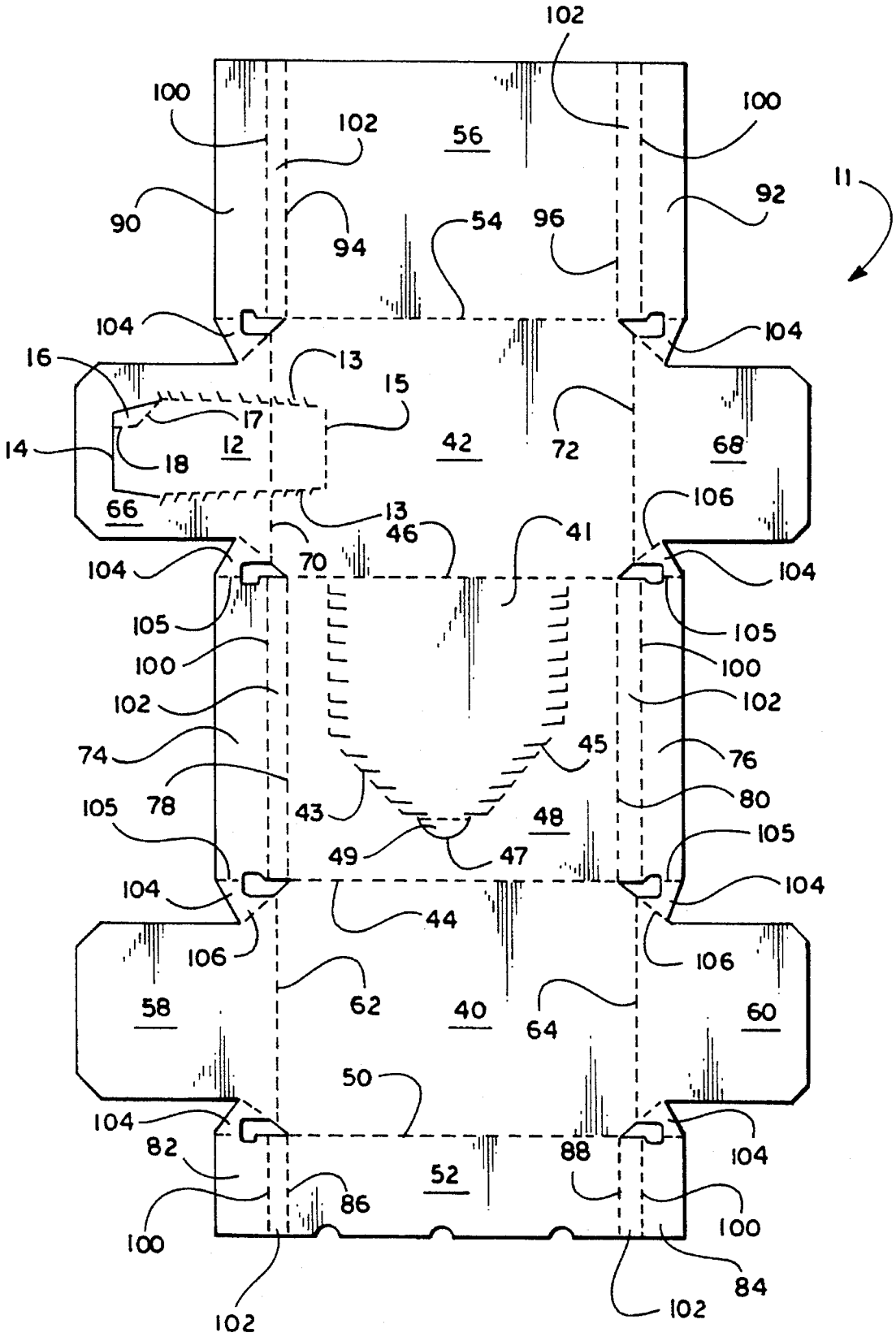
FIG. 4 is a plan view of the outer surface of a blank for forming a carton within which the tiers of cans and panel of FIG. 3 would be placed.

Referring now to FIG. 4, therein is illustrated for the purpose of further describing operation of the features of the divider panel 20 of the preferred embodiment of the invention a typical blank 11 for forming a carton with which the divider panel 20 may be used. As has been previously mentioned and as will be discussed in more detail below, the divider panel 20 is designed to be withdrawn through an opening in the erected carton. In the discussion which follows, the panel will be described as being withdrawn through the opening created by removing the end opening flap 12. The end opening flap 12 is defined by tear lines 13 inscribed in the end 66 and top 42 panels. A primary tear initiation slit 14 facilitates tearing open of the end opening flap 12. A fold line 15 for the end opening flap 12 extends between the tear lines 13. Tearing open of the end opening flap 12 is further facilitated by and may be initiated through a tear initiation tab 16 defined by primary tear initiation slit 14, secondary tear initiation slit 18 and tear fold line 17. The central body of the carton is formed from central panels 40, 42, 48, 52, 56. The central panels are connected to one another by various respective fold lines 44, 46, 50, 54. The end walls of the erected carton are formed from end panels 58, 60, 66, 68, 74, 76, 82, 84, 90, 92 connected along respective fold lines 62, 64, 70, 72, 78, 80, 86, 88, 94, 96 at the sides of respective central panels 40, 42, 48, 52, 56. In the typical blank 11 illustrated, bevelled corner panels 102 become bevelled corners of the erected carton. As previously mentioned, the corners of the divider panel 20 may be bevelled to accommodate a carton having bevelled corners. The bevelled corner panels 102 are created by the addition of fold lines 100 parallel to the fold lines 78, 80, 86, 88, 94, 96 between end panels 74, 76, 82, 84, 90, 92 and their respective central panels 48, 52, 56. Additional support structure consists of webs 104 and the fold lines 105 which help form them. For illustrative purposes, in addition to the end opening flap 12, a front opening flap 41 for removing cans 10 from an erected carton is also shown. The front opening flap 41 is defined by tear lines 43, 45. A front initiation slit 47 defines a pull tab 49 for facilitating tearing open of the front opening flap 41.

Figure 5:
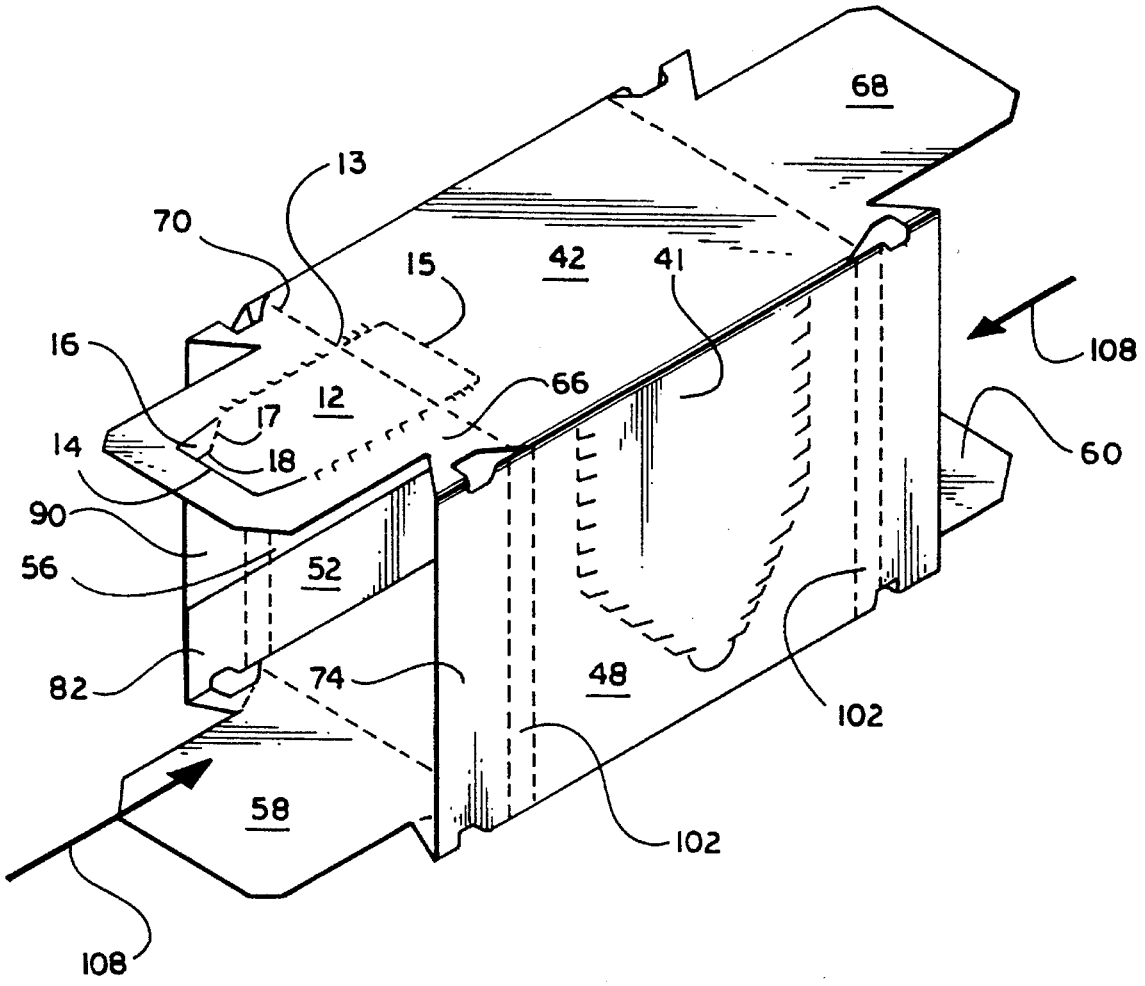
FIG. 5 is a perspective view of an erected sleeve formed from the blank of FIG. 4.

Referring now to FIG. 5, therein is illustrated the tube form of a carton partially erected from the carton blank 11. The arrangement of cans 10 and divider panel 20 as illustrated in FIGS. 2 and 3 may be loaded into the tubular carton through one or both of its ends as illustrated by the arrows 108 shown.

Figure 6:
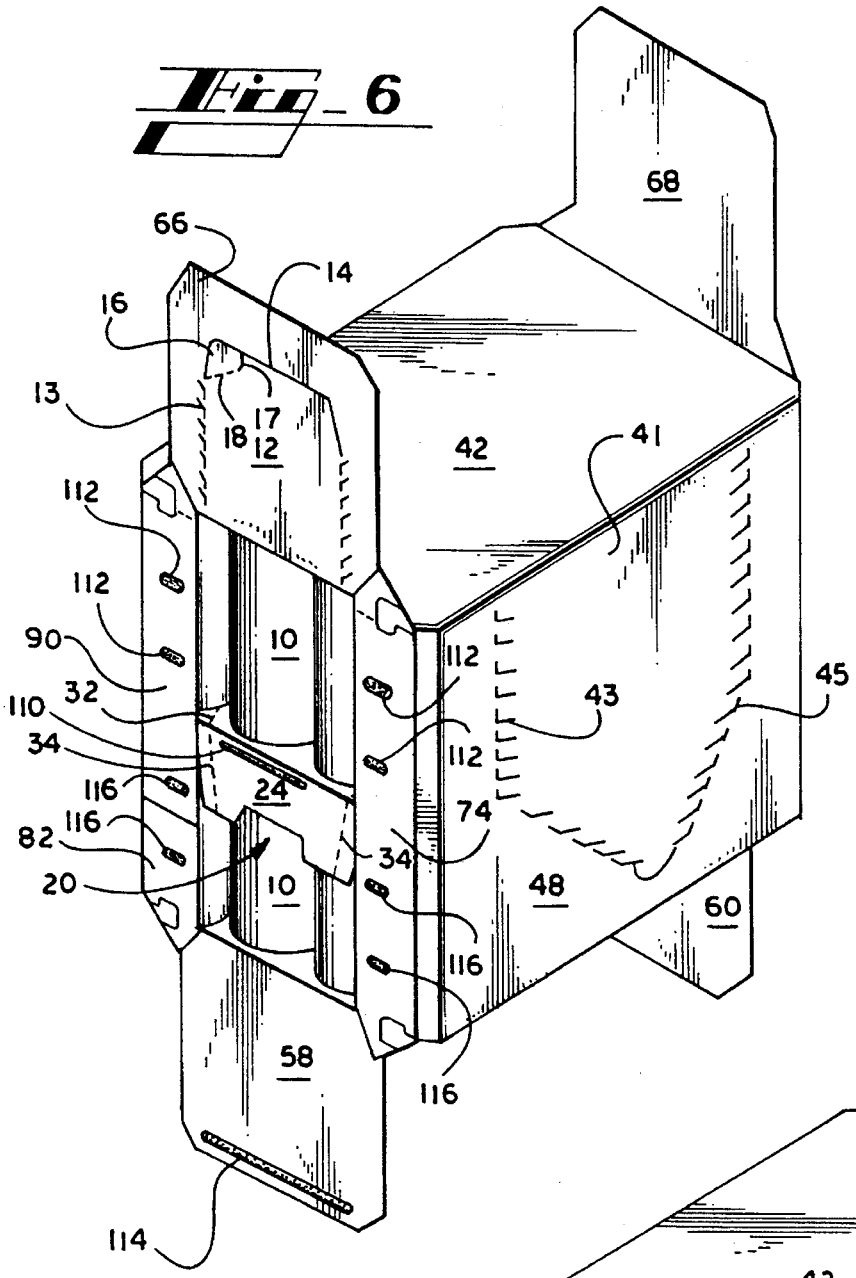
FIG. 6 is a perspective view of the erected sleeve of FIG. 5 loaded with the cans and panel of FIG. 1, showing the open ends of the sleeve partially closed and the position of an anchor flap for the panel ready for closure of the package.
Figure 7:
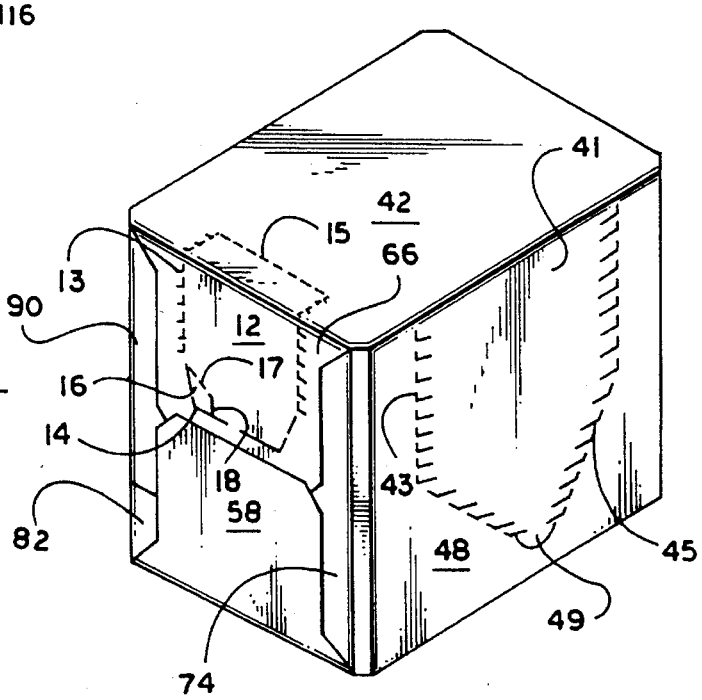
FIG. 7 is a perspective view of a completed package containing the divider panel of FIG. 1.

Referring now to FIG. 6, therein is shown the carton in its tubular configuration loaded with the two-tiered can 10 arrangement of FIGS. 2 and 3. An adhesive 110, 112, 114, 116 is affixed to the various flaps and panels to seal the carton. Most notably, an adhesive 112 may be placed upon the anchor flaps 24, 26 (one anchor flap 26 is not shown) of the divider panel 20 to secure the anchor flaps 24, 26 to the respective end panels 66, 68 of the carton. The fully sealed carton enclosing the multi-tiered can 10 and divider panel 20 arrangement is illustrated in FIG. 7.

Referring now to FIG. 8, therein is shown the package formed from the carton, cans 10, and divider panel 20. The end opening flap 12 has been lifted to provide access to the interior of the package. The upper tier of cans 10 has been removed and the divider panel 20 is revealed. In this view, two scored bend lines 28, 30 and one of the apertures 37 and its punch-out tab 38 can be seen.

Referring now to FIG. 9, the divider panel 20 is shown partially removed from the carton through the opening created by lifting the end opening flap 12.

In using the divider panel 20, the anchor flaps 24, 26 are immobilized to help secure the panel 20 in place in the carton. Although the anchor flaps 24, 26 of the divider panel 20 may be glued to the inner surfaces of the carton (as illustrated in FIG. 6) as a means for securement, the anchor flaps 24, 26 may also be secured by the force exerted upon the anchor flaps 24, 26 when they are sandwiched between the cans 10 and walls of the carton. Once the upper tier of cans 10 has been removed from the package the major panel 22 of the divider panel 20 is accessible through the opening of the carton used to withdraw cans 10. The major panel 22 may be torn away from the immobilized anchor flaps 24, 26 along the perforated fold lines 23. Once the major panel 22 has been separated from the anchor flaps 24, 26, an individual may remove the major panel 22 from the carton by inserting fingers through the apertures 37 to grasp the major panel 22 and lift the major panel 22 through the opening of the carton as illustrated in FIG. 9. The apertures 37 may also be used to manipulate the major panel 22 to tear the major panel 22 away from the secured anchor flaps 24, 26. The major panel 22 is curled or bowed into a frustum-like shape so that it will be narrow enough to be withdrawn through the opening of the carton. When the major panel 22 is curled, the scored fold lines 28, 30, 32 cause the major panel 22 to bend about those lines 28, 30, 32. The major panel 22 may be easily curled into the frustum shape at the end first passing through the opening of the carton because of the pattern inscribed by the scored fold lines 28, 30, 32. As the scored fold lines 28, 30, 32 diverge from the front end toward the rear end of the major panel 22, bending of the major panel 22 is less acute but sufficient to allow the end of the major panel 22 to be curled under and easily withdrawn from the carton.

If the anchor flaps 24, 26 are not glued to the inner surface of the carton, the entire divider panel 20 including the anchor flaps 24, 26 may be lifted from the lower tier of cans 10 and removed from the carton. In this alternate form of removal, the scored fold lines 34 cause the front end flap 24 to be bent about the fold lines 34 into a shape which becomes an upper portion of the frustum-shaped, curled panel 20. The bevelled configuration of the side of each anchor flap 24, 26 helps produce a more tapered front for the curled panel 20.

The divider panel 20 may be used in several ways in conjunction with an opening in the front of the carton which is created by lifting the front opening flap 41. In one manner, the divider panel 20 and its various features may be oriented for placement and removal with respect to the front opening in the same manner as placement and removal from the end opening is achieved. In another manner, the front opening may be used to detach the major panel 22 from the anchor flaps 24, 26 or lift the entire panel from the lower tier, but removal of the major panel 22 or entire divider panel 20 from the carton would still be accomplished through the side opening.

Figure 10:
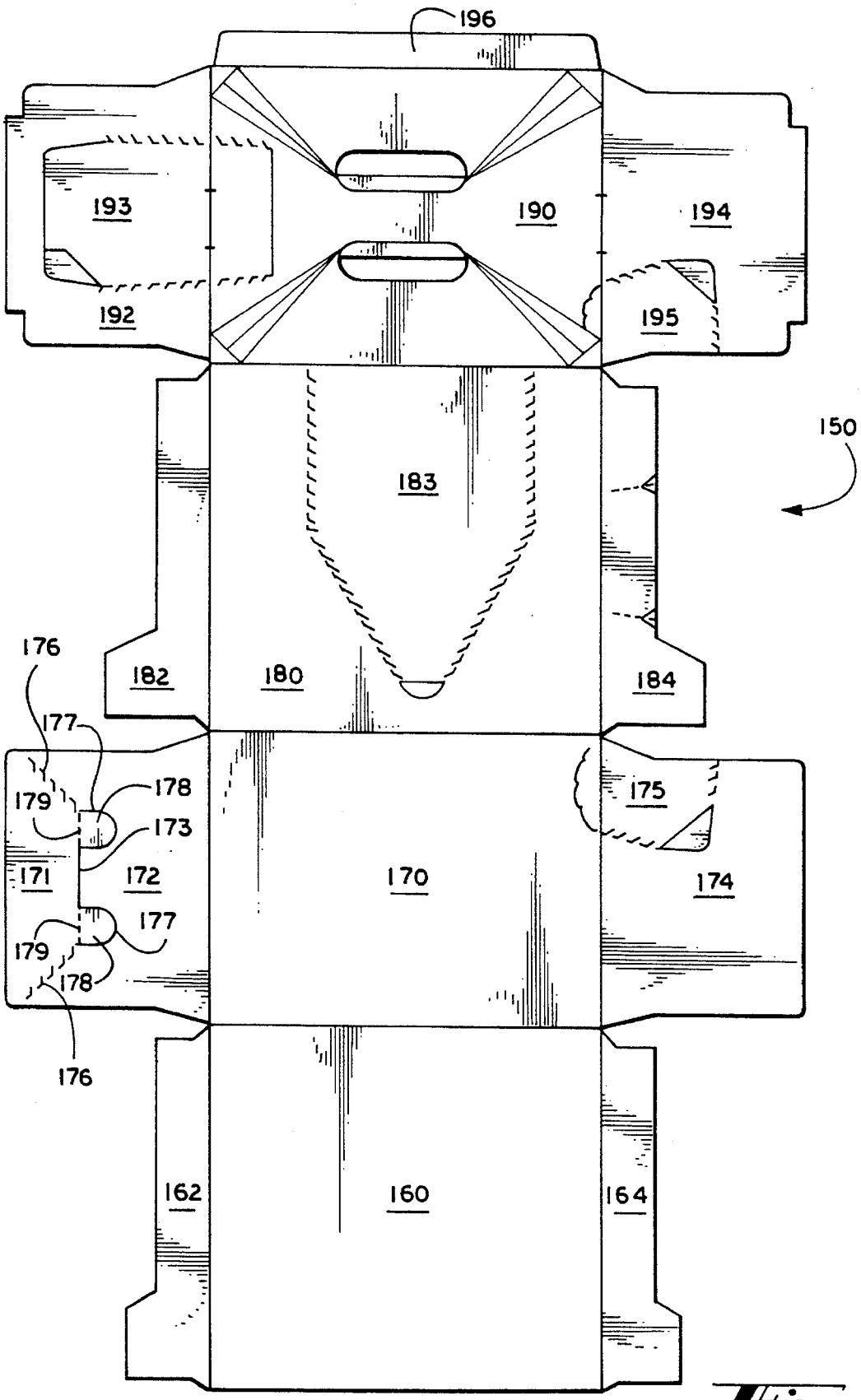
FIG. 10 is a plan view of the outer surface of a blank for forming a carton having integral means for facilitating removal of a divider panel, in accordance with a preferred embodiment of the present invention.

An alternate method of removing a divider panel from a package is to construct a carton which allows the divider panel to be removed directly through a wall of the carton. Referring now to FIG. 10, therein is illustrated a blank 150 for forming a carton having integral means formed in the carton for removing a divider panel through a wall of the carton. The divider panel of the invention may be formed into many different configurations of blanks. A typical blank suitable for use with the invention is shown. In general, the blank 150 has a primary rear central panel 160 with opposing end flaps 162, 164; a bottom central panel 170 with opposing end flaps 172, 174; a front central panel 170 with opposing end flaps 182, 184; a top central panel 190 with opposing end flaps 192, 194; and a secondary rear central panel 196. The front panel 180 contains a front opening flap 183. Corner can dispenser flaps 175, 195 for the respective top and bottom corners of the carton are formed in an end flap 174 of the bottom central panel 170 and an end flap 195 of the top central panel 190, respectively. A side flap 192 of the top central panel 190 contains an end opening flap 193. An end flap 172 of the bottom central panel 170 contains a means for removing a divider panel from a carton erected from the blank 150. The means for removable of a divider panel is essentially a flap 171 which is able to be affixed to an anchor flap of the divider panel and subsequently torn away from the end flap 172 of an erected carton. The tear-away flap 171 is connected to the end flap 172 along cut line 173, tear lines 176 and cut lines 177 which define the punch-out tabs 178. The punch-out tabs 178 extend from the tear-away flap along fold lines 179. The punch-out tabs 178 are positioned on the end flaps 172 so that when a carton is erected from the blank 150 the punch-out tabs are positioned over the vertical spaces between adjacent cans 10. This feature will be described in more detail below.

A carton erected from the blank 150 is designed for use with the removable divider panels 20 of the invention discussed above. To use the tear-away flap 171 feature of the invention, the inner surface of the tear-away flap 171 is affixed to an anchor flap, such as the anchor flap denoted by numeral 24 for panel 20. To illustrate a manner in which an anchor flap may be attached to the inner surface of the tear-away flap 171, reference is now momentarily made back to FIG. 6, in which an adhesive 110 is illustrated deposited upon anchor flap 24 for adherence of the associated end flap 58 of the bottom panel to the anchor flap 24. Similarly, the inner surface of the tear-away flap 171 attached to end flap 172 may be attached to the anchor flap of a divider panel in the same manner. Referring now to FIG. 11, therein is illustrated a carton erected from the blank 150.

Referring now also to FIG. 12, therein is illustrated the carton shown in FIG. 11 constructed from the blank 150 with the end dispensing flap 193 open. In this view, the top tier of cans 10 has been removed and the tear-away flap 171 has been torn from the end flap 172 to remove the divider panel 152. The divider panel 152 is shown partially removed from the carton. To remove a divider panel 152 from the carton after the upper tier of containers has been removed, fingers of an individual may push through the punch-out tabs 178 and then lift upward and outward to tear away the tear-away flap 171 along the tear lines 176. Although the bottom tier of cans 10 and package which surrounds them are tightly engaged, an individual may easily push through the punch-out tabs 178 because they are aligned over the spaces between adjacent cans 10 created by the curvature of cans 10. This alignment of one punch-out tab 178, defined by the line 177, over the vertical space created between two adjacent cans is visible in the illustration of FIG. 12. As the tear-away flap 171 is lifted, the anchor flap which has been affixed to the inner surface of the tear-away flap 171 (as described above) is also lifted. The anchor flap at the end of the divider panel opposite the attached tear-away flap may be removed from engagement between the carton end wall and cans or may be torn away from the major panel 22, 122 of the divider panel (as described previously herein) to permit the major panel 22, 122 to be withdrawn from the interior of the carton. The major panel 22, 122 and possibly anchor flaps 24, 124, 26, 126 may be manipulated and folded and bent along scored lines (as previously discussed above). As previously described above, the panel, 20, 152 may be curled or bowed into an appropriate shape for removal from the carton. In order to remove the panel 152 from the carton formed from the blank 150 of the invention, the panel 150 is curled sufficiently to facilitate withdrawal through the opening in the side of the carton created by removal of the tear-away flap 171.

Other modifications may be made in the foregoing without departing from the scope and spirit of the claimed invention. Although preferred embodiments of the invention have been described with reference to beverage cans, the divider panel 20 may also be used to separate containers stackable in arrays similar to the arrays of beverage cans 10 described above. Any containers which are compatible with the features of the divider panel 20 described herein are suitable. For example, the divider panel 20 may be used to separate tiers of individual-serving-size milk cartons which cartons have a steeple-shaped top. When used to separate such containers, the apertures 37 of the divider panel 20 provide access to the spacing between milk cartons and the tops of the milk cartons.

What is claimed is:

1. A divider panel for separating adjacent tiers of beverage cans in a package having a plurality of beverage cans arranged into a group of at least two vertically-aligned tiers encased by a carton including top and bottom panels interconnected by side panels, at least one side panel having a removable flap opening proximate the top panel for removing the cans from the carton comprising:

a major panel having a front edge and a rear edge and opposing side edges, having first and second parallel scored lines spaced apart parallel to said side edges extending between said front and rear edges, having at least one skewed scored line mediate each of said first and second parallel scored lines and said side edge most proximate said each of said first and second parallel scored lines extending from the intersection of said parallel scored line and said front edge, defining at least one aperture proximate said front edge suitable for receiving a finger therethrough to facilitate grasping and manipulation of said major panel; and first and second anchor flaps foldably and detachably joined respectively to said front and rear edges of said major panel.

2. A divider panel according to claim 1, said first anchor flap having first oblique side edges and said at least one skewed scored line mediate each said parallel scored line and said side edge most proximate said one of said first and second parallel scored lines including a pair of diametrically opposed said skewed scored lines extending through said first anchor flap to a leading edge of said first anchor flap.

3. A divider panel according to claim 1, said second anchor flap having second oblique side edges and a pair of secondary parallel scored lines coincident with said first and second parallel scored lines.

4. A divider panel according to claim 1, wherein a leading edge of one of said first and second anchor flaps is nestable with a leading edge of an other of said first and second anchor flaps.

5. A divider panel according to claim 4, wherein a leading edge of one of said first and second anchor flaps defines a notch and a leading edge of an other of said first and second anchor flaps defines a protrusion nestable with said notch.

6. A divider panel according to claim 1, said at least one aperture comprising two apertures.

7. A divider panel according to claim 1, wherein said at least one aperture contains a tab removably positioned within said aperture.

8. A divider panel for separating adjacent tiers of containers in a package for a plurality of containers, the containers arranged into a group of at least two vertically-disposed tiers, the group of tiers encased by a carton including top and bottom panels interconnected by side panels, at least one side panel having a removable opening proximate the top panel for removing the cans from the carton comprising:

a major panel having a front edge and a rear edge, defining at least one aperture suitable for receiving a finger therethrough to facilitate grasping and manipulation of said major panel; and a pair of anchor flaps foldably and detachably joined respectively to said front and rear edges of said major panel, wherein a leading edge of one of said pair of anchor flaps defines a notch and a leading edge of an other of said pair of anchor flaps defines a protrusion nestable with said notch.

9. A package comprising:

a plurality of beverage cans arranged into a group of at least two vertically-aligned tiers, each of said cans having a generally cylindrical side wall defining a cylindrical axis, said cans in each of said tiers having said axes thereof disposed vertically and parallel to each other;

a carton disposed around an exterior of said group of cans and including top and bottom panels interconnected by a pair of side panels to form a tubular structure, and a pair of end closure structures disposed to close opposite open ends of said tubular structure, said end closure structures being connected to said tubular structure and being disposed substantially adjacent said side walls of said cans of said group along opposite ends of said group, at least one of said side panels and said end closure structures having a removable flap opening for removing said cans from said carton; and a divider panel disposed between upper and lower adjacent ones of said tiers and in contact with said cans in said upper and lower adjacent tiers, said divider panel having a major panel having an area generally equal to a cross-sectional area of a lower tier of the group of at least two vertically-aligned tiers, having a front edge proximate said removable flap opening of said carton and an opposing rear edge, having a plurality of scored lines extending between said front and rear edges such that said major panel may be curled about said scored lines, defining at least one aperture proximate said front edge positioned over a lower of said tiers of cans such that said apertures are aligned over spaces between adjacent cans of said lower of said tiers of cans; and means for securing said major panel within the carton.

10. A package according to claim 9, wherein said major panel has a perimeter configuration generally corresponding to a perimeter configuration of a cross-section of the carton.

11. A package according to claim 9, wherein said plurality of scored lines comprises a first pair of parallel scored lines parallel to opposing side edges of said major panel and at least one skewed scored line beginning at said front edge of said major panel mediate one of said first pair of parallel scored lines and said side edge of said major panel most proximate said one of said first pair of parallel scored lines, extending generally toward said side edge most proximate said one of said first pair of parallel scored lines.

12. A package according to claim 11, wherein said first pair of parallel scored lines extend through said anchor flap which is foldably and detachably joined to said rear edge of said major panel.

13. A package according to claim 11, wherein said at least one skewed scored line includes a pair of diametrically opposed skewed scored lines and wherein said pair of diametrically opposed skewed scored lines extend through said anchor flap which is foldably and detachably joined to said front edge of said major panel.

14. The package of claim 9, said means for securing said major panel within the carton comprising a pair of anchor flaps foldably and detachably joined respectively to said front and rear edges of said major panel, adhesively secured to respective said end closure structures.

15. A package according to claim 14, wherein said plurality of scored lines includes a first pair of parallel scored lines parallel to opposing side edges of said major panel and wherein said first pair of parallel scored lines extend through said anchor flap which is foldably and detachably joined to said rear edge of said major panel.

16. A package according to claim 14, wherein said plurality of scored lines includes a pair of diametrically opposed skewed scored lines beginning at said front edge of said major panel and wherein said pair of diametrically opposed skewed scored lines extend through said anchor flap which is foldably and detachably joined to said front edge of said major panel.

17. A packaging system for multiple tiers of containers comprising:

a carton having a bottom wall, a top wall, a front wall and a rear wall forming a tubular structure, at least one end flap at each end of said tubular structure forming a closure structure, and an opening panel formed within at least one of said bottom wall, said top wall, said front wall and said rear wall;

a divider panel having at least one anchor flap for attachment to said closure structure such that said at least one divider panel may be disposed horizontally within said tubular structure; and divider panel removal means integrally formed with a said end flap of said closure structure affixable in flat face relation to said at least one anchor flap of the divider panel, adapted for removal from said end flap and withdrawal of said divider panel from an interior of the carton.

18. A packaging system according to claim 17, said divider panel removal means comprising a tear-away flap integrally formed with said end closure along a plurality of cut lines and tear lines.

19. A packaging system according to claim 18, said tear-away flap further having at least one tab foldably attached thereto adapted for being detached from said end flap to provide an aperture in said end flap adjacent said tear-away flap.

20. A packaging system according to claim 17, said at least one end flap at each end of said tubular structure forming a closure structure comprising an end flap attached to each side edge of said bottom wall and said top wall and said divider panel removal means comprising one of said end flaps having a plurality of tear lines and cut lines defining a tear-away flap positioned for face to face contact with the anchor flap of the divider panel.

21. A package comprising:

a plurality of beverage cans arranged into a group of at least two vertically-aligned tiers, each of said cans having a generally cylindrical side wall defining a cylindrical axis, said cans in each of said tiers having said axes thereof disposed vertically and parallel to each other;

a divider panel disposed between upper and lower adjacent ones of said tiers and in contact with said cans in said upper and lower adjacent tiers, said divider panel having a major panel having an area generally equal to a cross-sectional area of a lower tier of the group of at least two vertically-aligned tiers, having a front edge proximate said removable flap opening of said carton and an opposing rear edge, having a plurality of scored lines extending between said front and rear edges such that said major panel may be curled about said scored lines, defining at least one aperture proximate said front edge positioned over a lower of said tiers of cans such that said apertures are aligned over spaces between adjacent cans of said lower of said tiers of cans; and means for securing said major panel within the carton; and a carton disposed around an exterior of said group of cans and including top and bottom panels interconnected by a pair of side panels to form a tubular structure, and a pair of end closure structures disposed to close opposite open ends of said tubular structure, said end closure structures being connected to said tubular structure and being disposed substantially adjacent said side walls of said cans of said group along opposite end of said group, at least one of said side panels and said end closure structure having a removable flap opening for removing said cans from said carton, and divider panel removal means integrally formed with a said end closure structure in flat face relation with and affixed to said at least one anchor flap of the divider panel, adapted for removal from said end closure structure and withdrawal of said divider panel from an interior of the carton.

22. A package according to claim 21, wherein said major panel has a perimeter configuration generally corresponding to a perimeter configuration of a cross-section of the carton.

23. A package according to claim 21, wherein said plurality of scored lines comprises a first pair of parallel scored lines parallel to opposing side edges of said major panel and at least one skewed scored line beginning at said front edge of said major panel mediate one of said first pair of parallel scored lines and said side edge of said major panel most proximate said one of said first pair of parallel scored lines, extending generally toward said side edge most proximate said one of said first pair of parallel scored lines.

24. A package according to claim 23, wherein said first pair of parallel scored lines extend through said anchor flap which is foldably and detachably joined to said rear edge of said major panel.

25. A package according to claim 23, wherein said at least one skewed scored line includes a pair of diametrically opposed skewed scored lines and wherein said pair of diametrically opposed skewed scored lines extend through said anchor flap which is foldably and detachably joined to said front edge of said major panel.

26. The package of claim 21, said means for securing said major panel within the carton comprising a pair of anchor flaps foldably and detachably joined respectively to said front and rear edges of said major panel, adhesively secured to respective said end closure structures.

27. A package according to claim 26, wherein said plurality of scored lines includes a first pair of parallel scored lines parallel to opposing side edges of said major panel and wherein said first pair of parallel scored lines extend through said anchor flap which is foldably and detachably joined to said rear edge of said major panel.

28. A package according to claim 26, wherein said plurality of scored lines includes a pair of diametrically opposed skewed scored lines beginning at said front edge of said major panel and wherein said pair of diametrically opposed skewed scored lines extend through said anchor flap which is foldably and detachably joined to said front edge of said major panel.

* * * * *